US006655056B1

(12) United States Patent
Wolf et al.

(10) Patent No.: US 6,655,056 B1
(45) Date of Patent: Dec. 2, 2003

(54) TRADING CARD DISPLAY AND STORAGE DEVICE

(75) Inventors: Steve Wolf, 1262 Ranch View, Buffalo Grove, IL (US) 60089; John Pasternack, Palatine, IL (US)

(73) Assignee: Steve Wolf, Buffalo Grove, IL (US)

( * ) Notice: Subject to any disclaimer, the term of this patent is extended or adjusted under 35 U.S.C. 154(b) by 0 days.

(21) Appl. No.: 09/640,848

(22) Filed: Aug. 17, 2000

(51) Int. Cl.[7] ..... G09F 1/10

(52) U.S. Cl. ..... 40/124; 211/55; 211/128.1

(58) Field of Search ..... 40/124, 124.4; 211/55, 128.1, 126.2, 126.5; 273/298, 148 A, 244.2; D21/392

(56) References Cited

U.S. PATENT DOCUMENTS

| | | | | | |
|---|---|---|---|---|---|
| 2,742,290 | A | * | 4/1956 | Fasana | 273/244.2 |
| 3,179,479 | A | * | 4/1965 | Freedman | 211/128.1 |
| 3,351,402 | A | * | 11/1967 | Miller et al. | 312/233 |
| 3,777,897 | A | * | 12/1973 | Gray | 211/128.1 |
| 4,251,074 | A | * | 2/1981 | Welker | 273/317.7 |
| 4,634,125 | A | * | 1/1987 | Seklecki | 273/244.1 |
| 4,735,415 | A | * | 4/1988 | Corn | 273/317.7 |
| 4,735,469 | A | * | 4/1988 | Liggett | 312/233 |
| 4,801,023 | A | * | 1/1989 | Ecclestone | 211/128.1 |
| 4,944,968 | A | * | 7/1990 | Wagner | 428/13 |
| 5,026,058 | A | * | 6/1991 | Bromley | 463/3 |
| D333,846 | S | * | 3/1993 | Graham | D20/40 |
| 5,201,520 | A | * | 4/1993 | Castle et al. | 273/317.9 |
| D339,237 | S | * | 9/1993 | Korte | D6/303 |
| 5,289,926 | A | * | 3/1994 | Lewis et al. | 211/45 |
| 5,363,974 | A | * | 11/1994 | Chan | 211/126.2 |
| 5,394,996 | A | * | 3/1995 | Carpenter | 211/94.01 |
| 5,407,204 | A | * | 4/1995 | Meyer | 273/244.2 |
| 5,415,412 | A | * | 5/1995 | McMahon | 273/244 |
| D364,429 | S | * | 11/1995 | Crawford | D21/392 |
| 5,634,668 | A | * | 6/1997 | Barreiro, Jr. | 281/33 |
| D388,963 | S | * | 1/1998 | Williams | D6/303 |
| 5,820,127 | A | | 10/1998 | Rodriguez | |
| 5,823,359 | A | * | 10/1998 | Harris et al. | 211/11 |
| 5,938,048 | A | * | 8/1999 | Carroll et al. | 211/55 |
| 5,979,097 | A | | 11/1999 | Moore | |
| 6,113,096 | A | * | 9/2000 | Simmons | 273/108.31 |
| 6,142,315 | A | * | 11/2000 | Arout | 211/45 |
| 6,412,648 | B1 | * | 7/2002 | Woolnough et al. | 211/128.1 |

* cited by examiner

*Primary Examiner*—William L. Miller
(74) *Attorney, Agent, or Firm*—Greer, Burns & Crain, Ltd.

(57) ABSTRACT

Sports trading cards are attractively and functionally displayed and stored in an environment or setting related to the sport in which celebrity was achieved, comprising a replica of a sports stadium having a playing field for the play of a given sport and one or more sections to decks of spectator stands surrounding the field, the replication of the stands having slanted surfaces facing a simulation of the playing field for display of cards having relationship to the given sport.

9 Claims, 4 Drawing Sheets

TRADING CARD DISPLAY AND STORAGE DEVICE

FIELD OF THE INVENTION

The present invention relates to devices and methods for the attractive and functional display and storage of trading cards, especially sports trading cards.

BACKGROUND OF THE INVENTION

The business of making, buying, selling and trading cards depicting major sports figures and their accomplishments, for example, stars of professional baseball, football, basketball and hockey teams, has become a booming business. Major card-trading expositions are held regularly throughout the country and draw vast crowds of buyers, sellers and traders. Exhibitors are continually looking to improve the aesthetic and functional display of trading cards. Similarly, card collectors are continually looking for better display and storage devices for their card collections.

Various devices have been proposed and used for the attractive and functional display and/or storage of trading cards. Since the trading card business and culture are inexorably linked to sports, it would be desirable for the trading card display to reflect a sports theme. U.S. Pat. No. 5,979,097 to Danney E. Moore is typical of prior art card displays. It comprises a rectangular, clear plastic card holder in the nature of a picture frame. The Moore patent further discloses displays that include an audio device to emit pre-recorded material, such as the tune "Take Me Out to the Ball Park." U.S. Pat. No. 5,820,127 to Irma L. Rodriguez discloses a trading card apparatus and game board, including a rotating stadium for receiving, displaying, storing and sorting sports trading cards.

Prior art display and storage devices have not been entirely satisfactory, however. There is a need, therefore, for improved sports memorabilia displays and storage devices, especially card display and storage devices that reflect a sports theme.

SUMMARY OF THE INVENTION

It is the object of the invention to provide a device for the attractive and the functional display and storage of trading cards in a sports environment or setting conducive to the display and storage of the subject matter of the cards.

It is a particular object of the invention to provide for the attractive and functional display and storage of trading cards in replicas of stadiums in which the persons depicted on the cards performed, played or carried out the activities for which they acquired their fame, e.g., a replica of a baseball stadium for display of baseball player cards, a football field for display of football player cards, a hockey rink or hockey arena for display of hockey player cards, a basketball court or arena for display of basketball player cards, etc. In this way, the activities of the depicted players are more closely affiliated with the field of their activity in an attractive setting.

A more specific object of the invention is to provide a card display and storage device comprising a replica of a stadium having spectators stands, wherein the replication of the stands comprises surfaces for the display of cards.

Another more specific object of the invention is to provide a sports card display and storage device comprising a replica of a sports stadium having a realistic playing field for the play of a given sport and one or more modular decks and/or sections of spectator stands for fans viewing the sport. The replication of the stands comprises slanted surfaces for the display of sports cards having relation to the given sport. The slanted or inclined surfaces may be either flat or stair-stepped. Each deck or section is modular and may be readily snapped together or apart. A card collector may begin with the field of play and one section or deck of stands. As the collector's card collection grows, he may purchase additional sections or decks. The various sections or decks may be snapped in place, owing to the modular design.

Still another specific object of the invention is to afford to the art a process of providing for the attractive display and storage of sports cards comprising the steps of replicating on a minor scale a sports stadium having a playing field for the play of a given sport and one or more decks or sections of spectator stands for fans viewing the sport, replicating the spectator stands as surfaces facing the playing field, and displaying on the surfaces sports cards related to the given sport.

These and other objects, features and advantages of the invention will become apparent to those of reasonable skill in the art from the following detailed description, as considered in conjunction with the accompanying drawings.

DESCRIPTION OF THE BEST MODE OF PRACTICING THE INVENTION

The following is a detailed description of a representative embodiment of a trading card display and storage of the invention which is presently deemed by the inventor to be the best mode of carrying out the invention. As will presently appear, the display and storage device of the invention is equally adaptable to other forums, fields and venues and the best mode should not be deemed limited to baseball.

The replica stadium employed in practice of the invention may be of substantially any forum open for public performances. However, since cards depicting well-known and famous or infamous personages are presently concentrated primarily on participants in major professional sports, the replica stadium will for most applications replicate a sports venue. These venues are variously known as stadiums, fields, arenas, rinks, courts, tracks, parks, ballparks, etc. In general, they are comprised of a competition or playing field and contiguous spectator stands to accommodate people (fans) who wish to view the performance. For convenience, they will all be referred to herein under the generic term "stadium." The stadium may be a replica of an actual stadium, e.g., Chicago's Wrigley Field, a past stadium such as New York's Ebett's Field, or may be a generic stadium.

Figure 1:
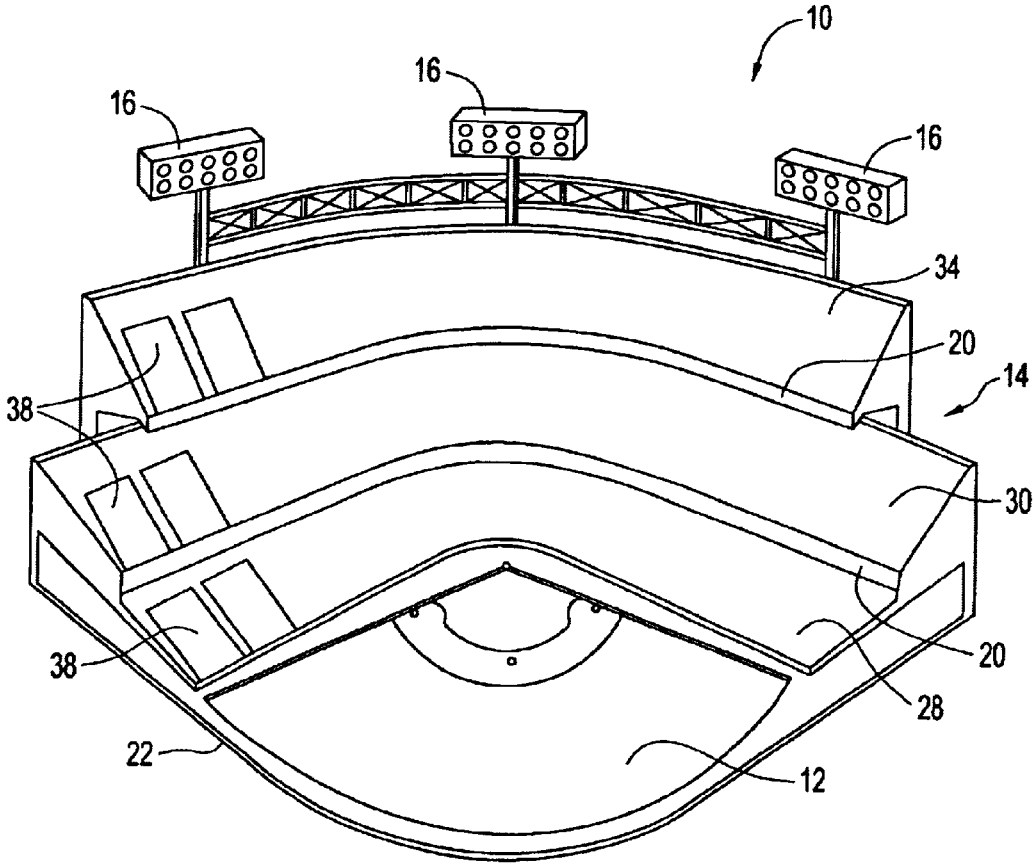
FIG. 1 is a perspective view of a miniature replica of a baseball stadium as viewed from center field and illustrating grandstands above the field of play.
Figure 2:
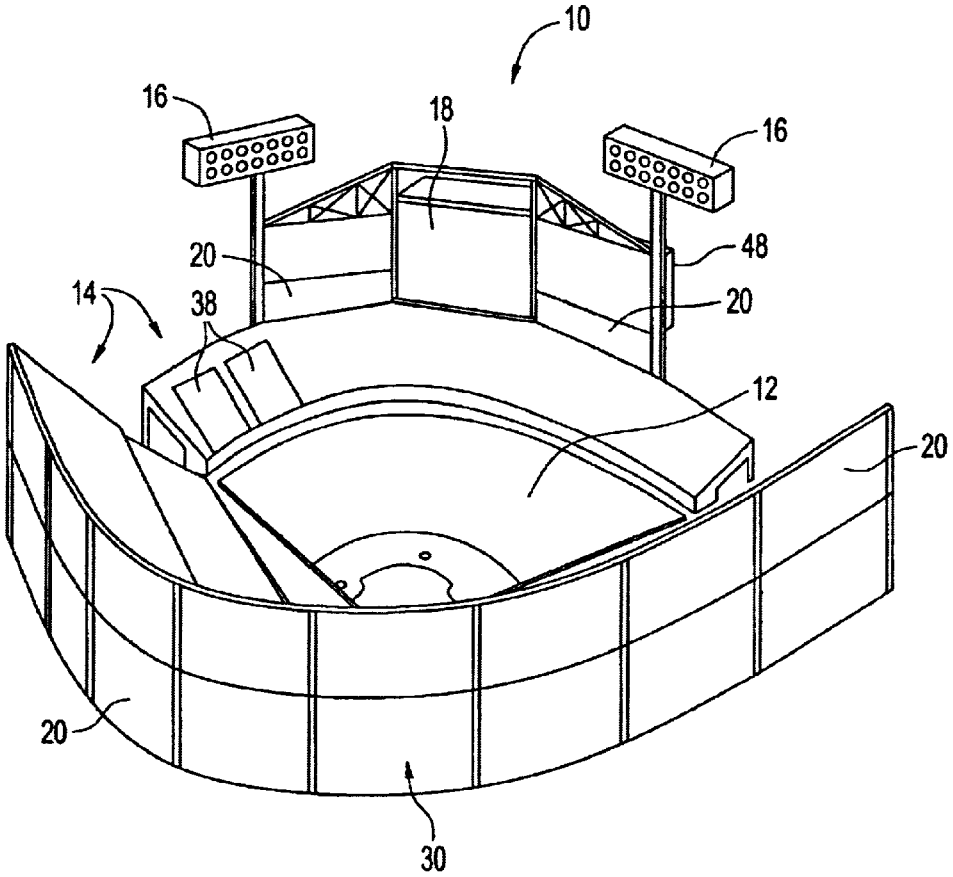
FIG. 2 is a perspective view of the same replica as shown in FIG. 1, but with the upper deck removed. The view is taken from above, behind home plate, and illustrates the left field stands, the center field bleachers, center field scoreboard and giant screen television, advertising spaces, and light towers.

As shown in FIGS. 1 and 2, the depicted embodiment of the invention is comprised of a small or miniature replica of a stadium 10 having a field 12 of competition or play and surrounding spectator stands 14. For a more realistic replication of the environment, the stadium and/or stands may include replica of light towers 16, a scoreboard and giant television screen 18, advertising spaces 20 (on both the interior and exterior of the replicated stadium), stadium sky boxes and such other accouterments as may traditionally, or more recently, be associated with play of the sport or game.

As illustrated in the drawings, the replication of the spectator stands includes the tiers, decks and sections customary for a stadium employed for the particular sport.

Figure 3:
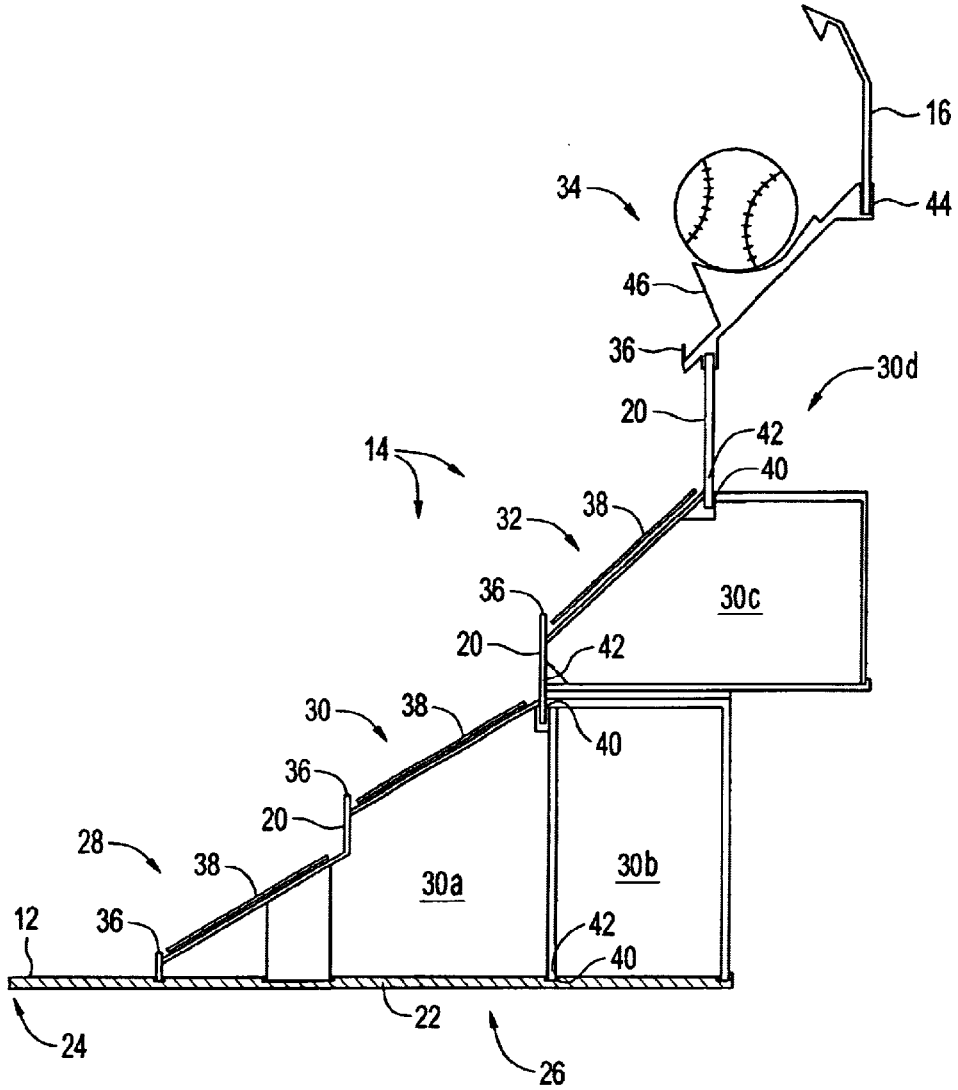
FIG. 3 is a cross-sectional view, of a representative replica of a portion of the spectator stands of the invention.

Referring to FIG. 3, the device of the invention in its preferred embodiment is comprised of a base 22 having a portion, indicated fragmentarily at 24, which (as shown in FIGS. 1 and 2) bears a depiction or simulation 12 of the field of play and a contiguous stand mounting area 26.

Figure 4:
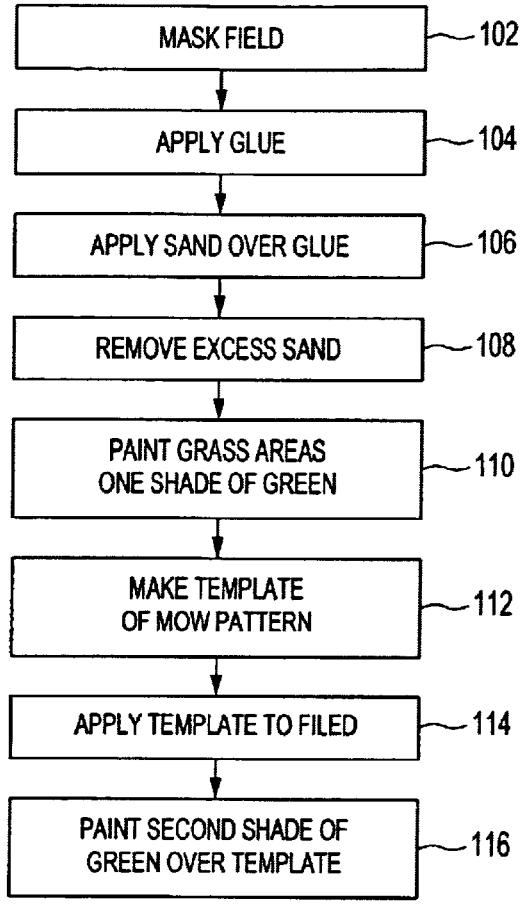
FIG. 4 is a flow chart illustrating the steps for replicating a field of play.

Referring to FIG. 4, the field of play may be simulated conveniently and economically by masking the field of play 102; applying glue 104, e.g., with a roller, to the field of play area 24; adhering sand 106 to the glue-bearing area; removing excess sand 108; and painting or airbrushing the sand 110 to simulate or depict in miniature a selected playing field, e.g., a baseball field. The step of painting preferably is done by first painting the field a dark shade of green 110; a template is made 112 depicting a lawn mowing pattern and is placed over the field 114; and a second lighter shade of green is painted 116 over the first layer 110. The sand may be left unpainted or tinted brown in the areas that are traditionally formed of dirt or sand, e.g., the batter's box, the base paths and the pitcher's mound: By using the template or stencil and two shades of green paint, the replica simulates the grass mowing patterns typically seen in major sports stadiums. For other sports, a realistic field or floor may be provided. For example, a parquet floor may be provided for a basketball arena. For hockey, a scuffed sheet of plexiglass may be applied over an appropriately painted board to simulate an ice rink.

The replication of the spectator stands may include, by way of example, a field level section 28, a plaza level section or deck 30, a stadium level or deck 32, and an upper level section or upper deck 34. At least some of the sections or decks are of inverted box-like construction and define within their interiors spaces 30*a–d* for storage of cards that are not on display. The storage space may take the form of cubby holes, cabinets, or drawers. Most preferably, the storage space is equipped with drawer mounts on slide tracks. The replica stadium may be sized to display 50 or more cards and provide storage for 800 to 2000 additional cards.

A unique feature of each of the decks is that the upper surface thereof is a flat or planar surface that slants in the direction of and faces the field of play, has a vertical stop 36 at the lower edge thereof and is of a size to hold individual sport cards 38. Alternatively, the slanted upper surface of the deck may be stair-stepped. Other means such as pockets, jackets or clips may be used to hold trading cards in an inclined position facing the field of play. Thus, each card rests in an inclined position on a replicated spectators' stand facing toward the field of play where the card is clearly visible to collectors, buyers, traders and other people. The cards are thereby displayed in an environment relevant to the achievements of the person depicted on the card. Additional cards may be displayed on the field of play or attached to the outer surfaces of the stadium.

Figure 5:
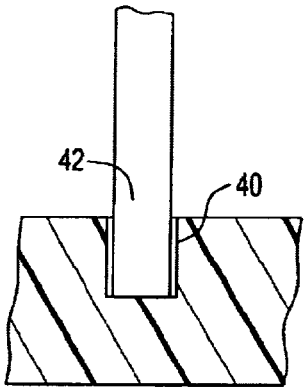
FIG. 5 is a detail showing a representative cooperative mounting means.

The base 22 of the device and the replicated spectator stands 28, 30, 32 and 34 are provided with cooperative mounting means, such as cooperative interlocking slots and projections, indicated in FIG. 5 at 40–42, for detachably connecting the replicated spectators stands, decks and/or sections to one another and the base 22. The light towers 16 may in like manner be detachably mounted to the upper deck 34, as indicated at 44.

In addition to sports cards, trading expositions frequently include other sports memorabilia, such as balls autographed by sports stars. The device of the invention accommodates attractive display and/or storage of such memorabilia as well as cards. For example, as illustrated in FIG. 3, a ball holder, in this case a baseball holder 46 having a hemispherical recess for reception of a baseball, may be mounted on the slanted surface of one of the decks, preferably the upper deck, to display an autographed ball. Alternatively, a ball holder may be provided in the field of play. Here again, the ball is displayed in an environment or setting relevant to the achievements of the person who signed the ball.

By virtue of the detachable assembly of the base and the replicated grandstand sections, the display device is of modular construction. Modular construction has several benefits. A card collector may purchase individually each component section, deck, scoreboard, light tower or other accessory. In this way, a collector may customize the stadium as may suit his/her particular requirements or taste. Further, a collector may start with a basic kit, e.g., the field and the plaza level stands. Other stands, decks and accessories may be added as desired.

A second advantage of modular construction is that the display may be readily disassembled and reassembled. This feature will be of particular benefit for the exhibitor for convenient transport from trading exposition to trading exposition, and for ready reassembly at the next stop on the exposition tour.

The specific manner of modular construction is not important, and variations will be readily apparent to persons skilled in art. For example, the stadium of FIG. 1 shows an upper deck 34 that is cantilevered over the lower decks 28, 30. FIG. 3 shows an alternative form of construction where upper deck 34 is mounted on a wall over stadium deck 32. Stadium deck 32 is supported directly by plaza deck 30. All forms of deck construction are intended to be covered by the appended claims.

Figure 6:
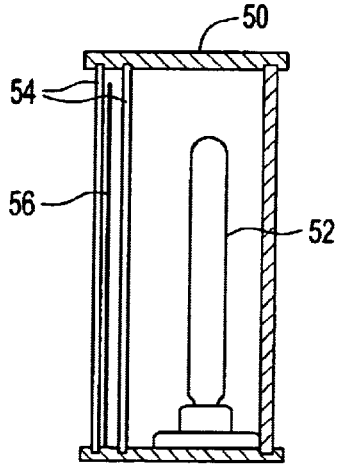
FIG. 6 is a cross-section through a replica scoreboard television.

The scoreboard 48 is shown in greater detail in FIG. 6. A replica giant television 50, e.g. Sony Diamond Vision, is provided. Desirably, the replica television 50 comprises a back lit photo box. The box comprises one or more illumination devices, such as incandescent light bulbs 52; and means 54 for holding a photograph 56 or other display items. Alternatively, the replica giant television could be on actual video display to display television programming, recorded video, or real time sports scores via a wireless link.

The materials of construction of the device are selectable from a wide variety of materials, such as wood, plastic, cardboard, fiberboard, composites, metals and glass, which ever best suits the ends of durability, portability and economy required by a particular displayer of wares.

The replica stadium of the invention includes various advertising spaces 20 that re customary in major sport venues. An advantage of the invention is that these advertising spaces may be sold to third parties, more specifically, the same companies that traditionally advertise in major sports stadiums.

The objects and advantages of the invention have therefore been shown to be attained in a convenient, economical, practical and facile manner. While a preferred embodiment of the invention has been herein illustrated and described, it is to be appreciated that various changes, rearrangements and modifications may be made herein without departing from the scope of the invention as defined by the appended claims.

What is claimed is:

1. A process of providing for the attractive display of sports cards related to a given sport comprising the steps of:

replicating in miniature scale a sports stadium having a playing field for the play of the given sport and one or more decks or sections of spectator stands for fans viewing the sport, replicating grass mowing patterns on the playing field, replicating the spectator stands as inclined means for displaying the sports cards facing the replication of the playing field, and displaying in the inclined means said sports cards related to said given sport, said step of replicating grass-mowing patterns comprising making a template depicting the mowing pattern, painting the field one shade of green, applying the template to the field, and painting over the template with a second shade of green.

2. A device for displaying cards comprising a replica of a stadium, said device comprising a base having a playing field depicted thereon and a spectator stand mounting area, and a plurality of tiers of replicated spectator stands on said mounting area, said tiers of stands being of modular construction for conjoint assembly and including cooperative means for detachably securing said tiers to one another, said tiers of stands each comprising an inclined surface slanted downwardly and towards said field having a stop on a lower edge of said surface for holding and displaying the cards, said cooperative means assembling said tiers such that each said inclined surface and the card displayed thereon are clearly open to view, and wherein one or more of said tiers of replicated spectator stands having box structures and said inclined surface comprises the upper surface of said box structures, said box structures each forming a storage space below the inclined surface for storage of additional cards and including an access opening to said storage space for readily gaining access to said space without disassembling said spectator stands.

3. A sports card display device as set forth in claim 2 including a ball holder detachably secured to at least one of the said base or tiers, said ball holder having a hemispherical recess for receiving and holding a ball.

4. A device as set forth in claim 2, wherein said plurality of tiers includes a lower tier and an upper tier, said upper tier being detachably secured to said lower tier and said upper tier being spaced upwardly from and cantilevered over said lower tier.

5. A device as set forth in claim 2 wherein said cooperative means comprises a slot in a lower one of said tiers and a wall projecting downwardly from an upper one of said tiers, said wall interlocking with said slot.

6. A device as in claim 2 further comprising a replica giant television having a back lit photo box.

7. A device for displaying cards comprising a replica of a stadium, said device comprising a base having a playing field depicted thereon and a spectator stand mounting area, and a plurality of tiers of replicated spectator stands on said mounting area, said tiers of stands being of modular construction for conjoint assembly and including cooperative means for detachably securing said tiers to one another, said tiers of stands each comprising an inclined surface slanted downwardly and towards said field having a stop on a lower edge of said surface for holding and displaying the cards, said cooperative means assembling said tiers such that each said inclined surface and the card displayed thereon are clearly open to view, and wherein said plurality of tiers includes a lower tier and an upper tier detachably secured to said lower tier, said cooperative means including a slot on one of said tiers and a projection on the other of said tiers, said projection interlocking in said slot for detachably securing said upper tier to said lower tier.

8. A sports card display device comprising a replica of a sports stadium said device comprising a base having depicted thereon a playing field for the play of a given sport and a spectator stand mounting area contiguous to the depiction of the playing field, a plurality of tiers of replicated spectator stands on said mounting area extending along and complemental to the playing field, said tiers of stands being of modular construction for conjoint assembly and including cooperative means for detachably securing said tiers to one another, said tiers of stands each comprising an inclined surface slanted downwardly and towards said playing field having a stop on a lower edge of said surface, and a plurality of sports cards having relation to said given sport removably held and displayed on said inclined surfaces, said cooperative means assembling said plural tiers such that each said inclined surface and tie card displayed thereon are clearly open to view.

9. A device as set forth in claim 8 further comprising a replica giant television in said stadium, said replica television having a window, and at least one of said sports cards being displayed in said window of said replica television.

* * * * *